US006461701B1

(12) United States Patent
Schlueter, Jr. et al.

(10) Patent No.: US 6,461,701 B1
(45) Date of Patent: Oct. 8, 2002

(54) FLEXIBLE BELTS HAVING EMBEDDED SENSOR FIBERS

(75) Inventors: Edward L. Schlueter, Jr., Rochester; William E. Bond, Pittsford, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/464,034

(22) Filed: Dec. 15, 1999

(51) Int. Cl.[7] ..... G03G 15/16

(52) U.S. Cl. ..... 428/36.1; 428/36.2; 428/36.91; 428/192; 264/512; 264/513; 264/515; 264/532; 264/536; 427/74; 427/76; 427/108; 427/126.1; 427/126.3; 427/404; 427/419.1; 356/28; 355/133

(58) Field of Search ..... 356/28; 198/793, 198/804; 355/133; 428/192, 36.1, 36.2, 36.91; 264/512, 513, 515, 532, 536; 427/74, 76, 108, 126.1, 126.3, 404, 419.1

(56) References Cited

PUBLICATIONS

Fibreforce, Replacing Metals Where it Matters; "The Pultrusion Process," http://www.fibreforce.u–net.com/process.html.

Fibreforce, Replacing Metals Where it Matters; "Pullwinding," http;//www.fibreforce.u–net.com/pullwind.html.

Brochures by KaZak Composites Incorporated.

Brochures by Polygon, "Living with Composites Technology".

*Primary Examiner*—Rich Weisberger
(74) *Attorney, Agent, or Firm*—John M. Kelly; David E. Henn

(57) ABSTRACT

Flexible belts, and electrophotographic machines that use such flexible belts, that having embedded sensor fibers that run across the belt's width. Such sensor fibers enable sensors located along the side of the belt to sense belt position and/or motion.

20 Claims, 7 Drawing Sheets

FIG. 2
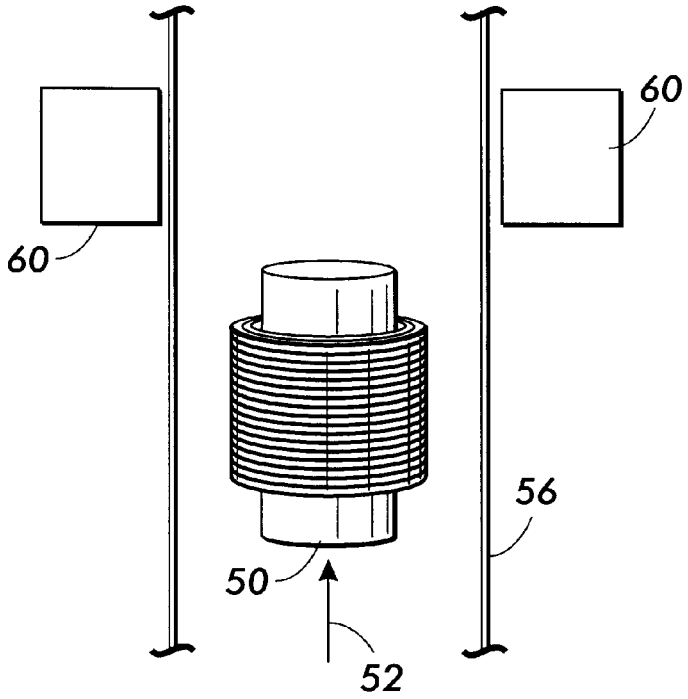
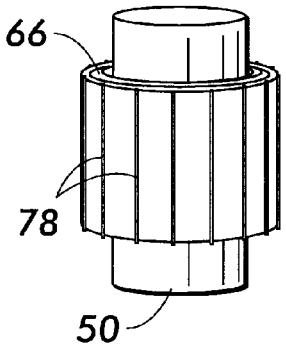
FIG. 3

FLEXIBLE BELTS HAVING EMBEDDED SENSOR FIBERS

FIELD OF THE INVENTION

This invention relates to flexible belts. More particularly it relates to flexible belts fabricated from embedded fibers that are useful for sensing belt properties, such as motion and position.

BACKGROUND OF THE INVENTION

Electrophotographic printing is a well known and commonly used method of copying or printing original documents. Electrophotographic printing is performed by exposing a light image representation of a desired document onto a substantially uniformly charged photoreceptor. In response to that light image the photoreceptor discharges, creating an electrostatic latent image of the desired document on the photoreceptor's surface. Toner particles are then deposited onto the latent image to form a toner image. That toner image is then transferred from the photoreceptor onto a receiving substrate such as a sheet of paper. The transferred toner image is then fused to the receiving substrate. The surface of the photoreceptor is then cleaned of residual developing material and recharged in preparation for the production of another image.

Many electrophotographic printers use flexible belts. For example, exposure is often performed on flexible belt photoreceptors, transfer often involves the use of flexible transfer belts, and fusing is often performed using flexible fusing belts. Flexible belts are of two types, seamed or seamless. Seamed belts are fabricated by fastening two ends of a web material together, such as by sewing, wiring, stapling, or gluing. Seamless belts are typically manufactured using relatively complex processes that produce a continuous, endless layer. In general, seamless belts are usually much more expensive than comparable seamed belts. While seamed belts are relatively low in cost, the seam introduces a "bump" that can interfere with the electrical and mechanical operations of the belt. For example, if a seamed belt is a photoreceptor the seam can interfere with the exposure and toner deposition processes, resulting in a degraded final image. It is possible to sense the seam and then synchronize the printer's operation such that the seam area is not exposed. That is, by knowing the location of the seam it is possible to time printing such that the seam is not imaged.

In the prior art seam sensing was accomplished by locating a "sensing element" on the belt and then sensing when that element passes a sensing station. For example, a slot can be formed through a belt and a transmissive electro-optical sensor system can be used to sense that slot. Known alternatives include using a reflector that is sensed by a reflective electro-optical sensor and a magnet that is sensed by a magnetic sensor. However, these prior art techniques either weaken the belt or take up some of the surface area of the belt, thus requiring larger belts.

In addition to tracking the seam area, it can also be beneficial to accurately track the belt's position over multiple locations and/or to accurately track the belt's rotation. For example, if multiple color images are to be transferred in close registration it is very important to accurately know where each color image is on the belt. Furthermore, by knowing the belt's position over time it is possible to accurately determine the belt's rotational velocity, and thus predict when a given belt location will pass a given point.

This is useful in determinative applications wherein a given electrophotographic station (such as exposure, development, or transfer) requires some advance notice before it operates or when belt velocity (or velocity variations) are important. Such applications usually require multiple sensing elements, with the more sensing elements being used the more accurately the belt's sensed parameters being known. However, locating multiple sensing elements on the belt weakens the belt further or takes up even more of the belt's surface area.

Electrophotographic printing belts, whether seamless or seamed, are usually comprised of multiple layers, with each layer introducing a useful property. For example, one layer might provide the majority of a belt's mechanical strength, another might introduce an imaging layer, another might improve a belt's toner release properties, while yet another might improve thermal insulation. Because multiple layers should be mutually compatible, and since such compatibility significantly limits that range of acceptable materials, manufacturing multiple layer electrophotographic printing belts is challenging.

Given the many application that make use of belt position information, the improved accuracy achievable by using multiple sensing elements, and the difficulty of manufacturing flexible belts a new type of belt having integral sensing elements, would be beneficial.

SUMMARY OF THE INVENTION

The principles of the present invention provides for flexible belts having embedded sensor fibers that run across the belt's width and that can be sensed by a sensor located on the side of the belt.

Electrophotographic machines that use such flexible belts locate sensors along the sides of the belt such that the sensor fibers are sensed. The sensors beneficially produce signals that can be used to determine belt position and/or motion.

BRIEF DESCRIPTION OF THE DRAWINGS

Other aspects of the present invention will become apparent as the following description proceeds and upon reference to the drawings, in which:

FIG. 2 illustrates passing a wound mandrel, prepared using the pultrusion machine of FIG. 1, through a die to smooth elastomer-soaked fibers into the shape of a belt and then curing the smoothed elastomer-soaked fibers into a belt;

FIG. 3 illustrates sensing fibers placed across a belt layer after curing;

DETAILED DESCRIPTION OF THE PREFERRED EMBODIMENTS

The principles of the present invention relate to flexible belts having embedded sensing elements that are located between belt layers and that run across the width of the belt. Because a modified pultrusion process is useful in producing flexible belts according to the principles of the present invention, the fabrication of an inventive belt using that process will be describe. However, it should be understood that fabrication using other process and that other types of flexible belts are also possible.

Pultrusion has become a widely used, cost effective method of manufacturing fiber-reinforced composite materials. Pultrusion is usually performed by pulling fibers from a fiber creel (rack) through a thermoset resin contained in a bath such that the fibers become soaked with resin. The soaked fibers are subsequently pulled through a heated die that cures the resin and the fibers to form a product that has the general form of the die. The cured product is then cut to a desired length. The fibers that are pulled through the resin bath may be individual fibers or part of a woven mat. The pultrusion process is well suited for the continuous production of products ranging from simple round bars to more complex panels. In the prior art, pultrusion has been used almost exclusively with various thermosetting plastics to produce structurally rigid forms having high specific strength and stiffness. Common process variations involve producing deformations in the curing fibers or winding the fibers before final curing to introduce spatial properties.

Figure 1:
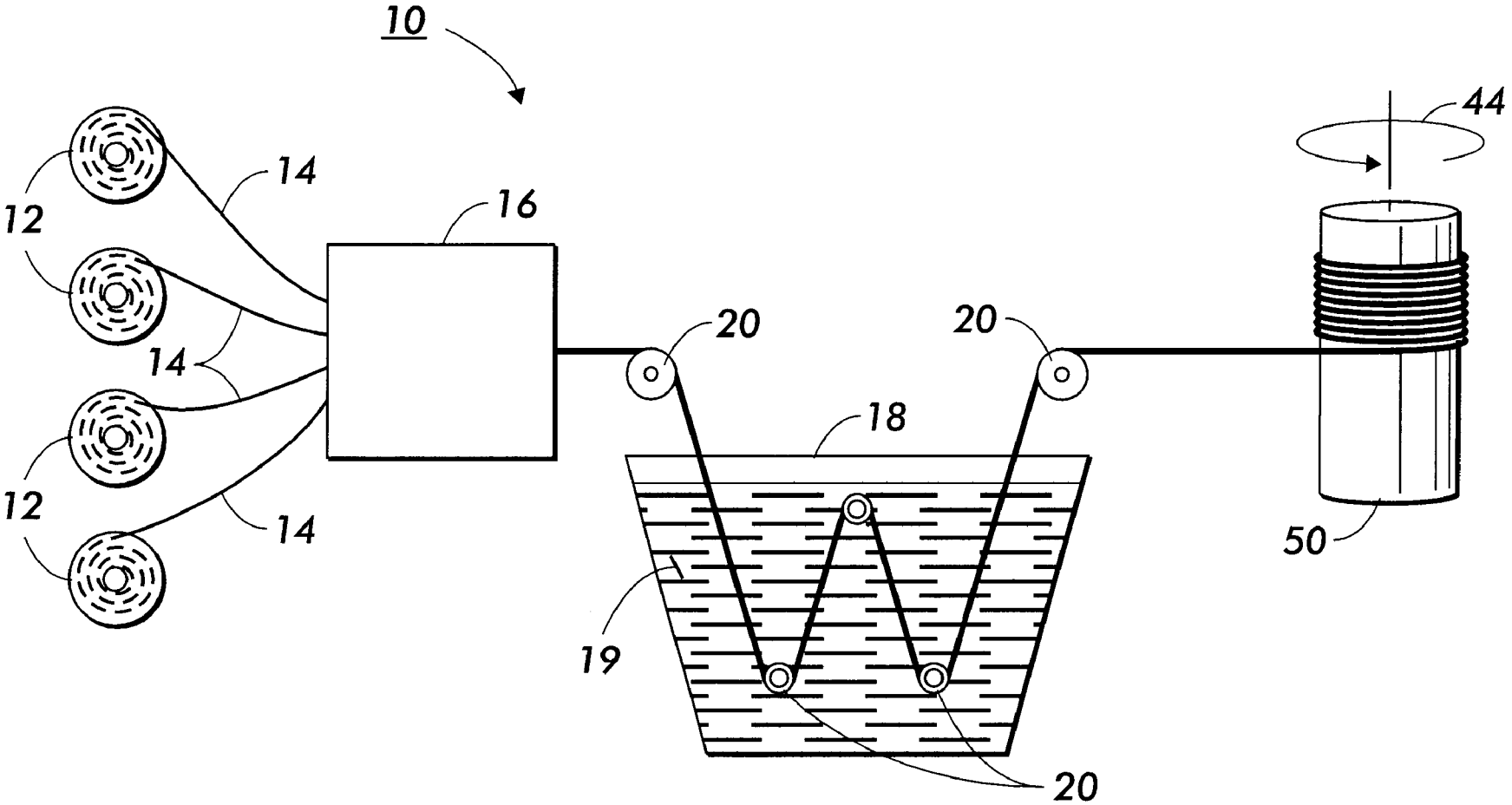
FIG. 1 schematically illustrates a pultrusion machine that is useful in preparing flexible belts according to the principles of the present invention.

However, a modified version of the pultrusion process is useful for producing belts according to the principles of the present invention. That process is beneficially implemented using a pultrusion machine 10 as illustrated in FIG. 1. That machine includes a plurality of creels or spools 12 from which fibers 14 are drawn in a manner that is described subsequently. Those fibers are gathered together by a pre-die 16 that assists the fiber to move smoothly through the remainder of the pultrusion machine 10. As the fibers continue being pulled, they exit the pre-die and enter a pultrusion bath 18. The pultrusion bath 18 contains a liquid elastomer 19 that cures to form a flexible material. When in the pultrusion bath the fibers pass between pulleys 20 such that the fibers dwell in the pultrusion bath 18 long enough to become thoroughly soaked with the liquid elastomer. The uncured liquid elastomer coated fibers are then directionally wound around a mandrel 50 that turns in the direction 44 so as to pull the fibers 14 from the spools 12.

Turning now to FIG. 2, after a belt layer having a desired thickness is formed on the mandrel 50 the wound mandrel is passed in a direction 52 through a die 56. The die smoothes the elastomer-soaked fibers into the shape of a belt. The wound mandrel continues to advance in the direction 52 until it comes to a curing station 60. Referring now to FIG. 3, the curing station cures the liquid elastomer on the fibers, resulting in a fiber-reinforced elastomer layer 66. A plurality of sensor fibers 78 are then placed across the width of the elastomer layer 66.

Figure 4:
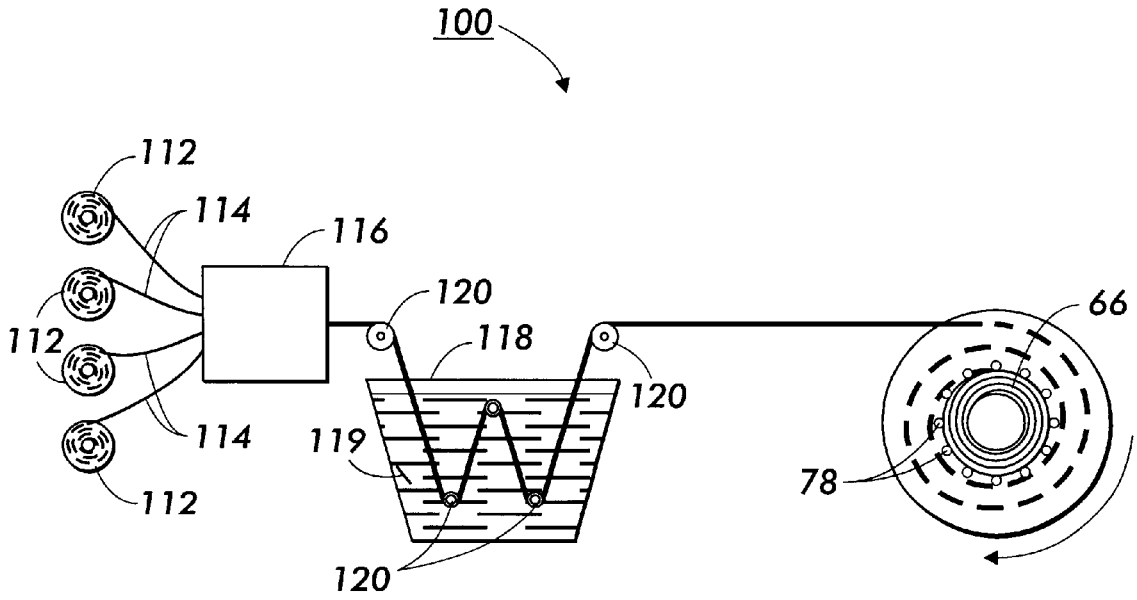
FIG. 4 schematically illustrates a pultrusion machine that wraps another belt layer of sensing fibers on an existing belt layer.

Referring now to FIG. 4, another layer of elastomer soaked fibers is then wound over the elastomer layer 66 and over the sensor fibers 78. As shown, a pultrusion machine 100 includes a plurality of creels or spools 112 from which fibers 114 are drawn. Those fibers are gathered together by a pre-die 116. As the fibers continue being pulled, they exit the pre-die and enter a second pultrusion bath 118 that contains a second liquid elastomer 119 that cures to form a second flexible material. When in the second pultrusion bath the fibers pass between pulleys 120 such that the fibers dwell in the second pultrusion bath 118 until they are thoroughly soaked with the second liquid elastomer 119. As the second liquid elastomer soaked fibers are pulled from the second pultrusion bath they are wound around the elastomer layer 66 and the sensing fibers 78.

Figure 5:
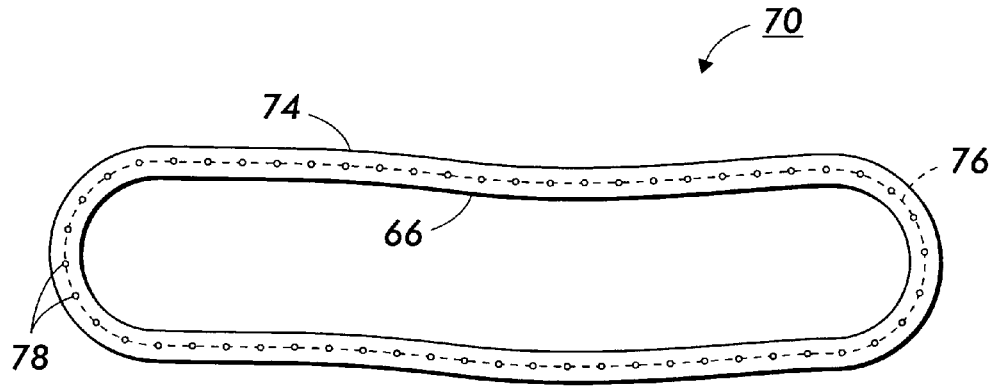
FIG. 5 shows a side view of a flexible belt that is in accord with the principles of the present invention.

After a second belt layer having a desired thickness is formed the wound mandrel is passed through a smoothing and forming die and a curing station as illustrated generally in FIG. 2. When the cured belt is removed from the mandrel a flexible belt 70 as illustrated in FIG. 5 results. That flexible belt has two layers of fiber-reinforced elastomers, one elastomer layer 66 that was coated with the liquid elastomer 19 and a second elastomer layer 74 that was coated with the second liquid elastomer 119. Those layers join at a seam 76. The sensing fibers 78 are located at that seam.

The sensor fibers 78 can be any of a number of sensor fibers that enable edge sensing of the belt. For example, the sensor fibers might be optical fibers that transmit light through the belt. Alternatively, they might be electrical conductors, magnetic elements, or rigid elements. If the sensor fibers are rigid elements those fiber should extend beyond at least one edge of the belt such that the fibers can be mechanically sensed.

In addition to carrying the sensor fibers 78 the flexible belt 70 can have engineered properties. For example, if a lightweight, durable belt is desired an aromatic polyamide, such as Kevlar™, fibers can be used. To impart high conformability, a liquid fluoroelastomer of vinylidene fluoride and hexafluropropylene, such as Viton™, possibly containing additives to improve its electrical properties can be used to coat the aromatic polyamide fiber to produce the first layer 72. Both Kevlar™ and Viton™ are available from E. I. Dupont. If the flexible belt is used as a transfer belt the fibers that form the second layer 74 could be coated with a silicon polymer to provide good toner release properties. Other useful belt materials include the urethanes. Of course, other combinations of fibers and liquid elastomers can be used to implement other desired properties. Additionally, the weave patterns of webbings made from the cured fibers can be controlled so as to introduce desirable belt properties. For example, by weaving fibers at acute angles with the circumference can produce elastic layers having preferred directions of elasticity.

Figure 6:
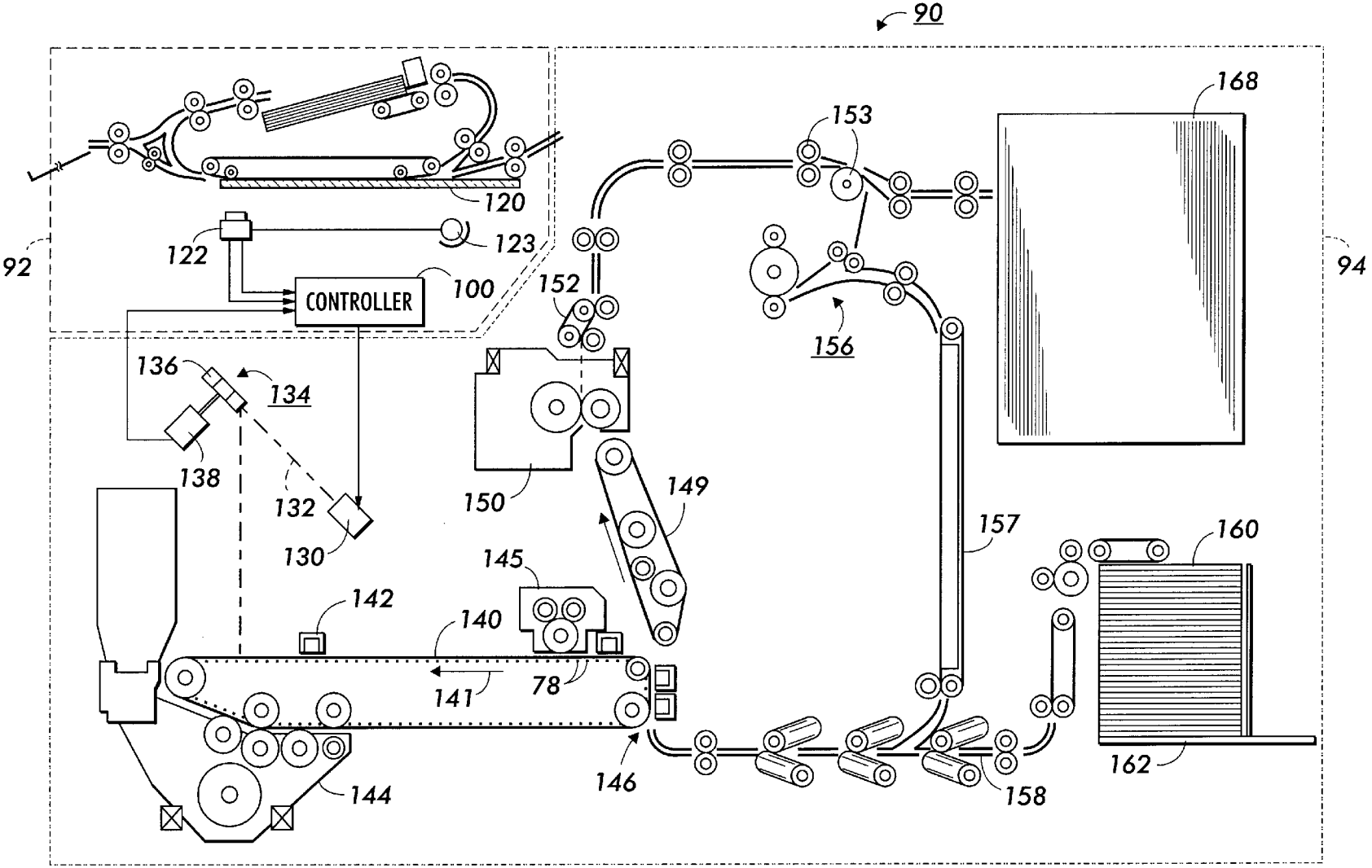
FIG. 6 schematically illustrates an electrophotographic marking machine, specifically a digital copier, the incorporates flexible belt that is in accord with the principles of the present invention.

Flexible belts according to the principles of the present invention are useful in electrophotographic marking machines. As an example, FIG. 6 illustrates an exemplary electrophotographic marking machine, specifically a digital copier 90 that makes use of flexible belts having embedded sensor fibers. Generally, the copier includes an input scanner 92, a controller section 100, and an electrophotographic printer 94. The input scanner 92 includes a transparent platen 120 on which a document being scanned is located. One or more photosensitive element arrays 122, which beneficially include charge couple devices (CCD), and a lamp 123 are supported for relative scanning movement below the platen 120. The lamp illuminates the document on the platen, while the photosensitive element array 122 produces image pixel signals from light reflected by the document. After suitable processing the image pixel signals are converted to digital data signals that are sent to the controller section 100.

The controller section 100, sometimes called an electronic subsystem (ESS), includes control electronics that prepare and manage the flow of digital data to the printer 94. The controller section may include a user interface suitable for enabling an operator to program a particular print job, a memory for storing information, and, specifically important to the present invention, circuitry for synchronizing and controlling the overall operation of the copier 90. In any event, the controller section sends processed digital data signals to the printer 94 as video data.

The printer 94 includes a raster output scanner that produces a latent electrostatic image on a charged photoreceptor 140 this includes embedded sensing fibers. The raster output scanner includes a laser diode 130 that produces a laser beam 132 that is modulated in accordance with the video data from the controller section 100. The video data encodes the laser beam with information suitable for producing the desired latent image. From the laser diode the laser beam 132 is directed onto a rotating polygon 134 that has a plurality of mirrored facets 136. A motor 138 rotates the polygon. As the polygon rotates, the laser beam 132 reflects from the facets and sweeps across the photoreceptor 140 while the photoreceptor moves in a direction 141. The sweeping laser beam exposes an output scan line on the photoreceptor 140, thereby creating an output scan line latent electrostatic image. The photoreceptor 140 is a flexible belt having embedded sensing fibers 78. As explained subsequently, those fibers are used to control the position of the scan line on the photoreceptor, specifically to compensate for errors in the photoreceptor motion.

Before exposure, the photoreceptor is charged by a corotron 142. After exposure, a developer 144 develops the electrostatic latent image. The result is a toner image on the photoreceptor. That toner image is transferred at a transfer station 146 onto a substrate 160 that is moved from an input tray 162 to the transfer station by a document handler 158. After transfer, the substrate is advanced by a document transport 149 into a fusing station 150. The fusing station permanently fuses the toner image to the substrate 160. After the toner image is transferred, a cleaning station 145 removes residual toner particles and other debris on the photoreceptor 140.

After fusing, the substrate 160 passes through a decurler 152. Forwarding rollers 153 then advance the substrate either to an output tray 168 (if simplex printing or after the fusing of a second image in duplex operation) or to a duplex inverter 156 that inverts the substrate. An inverted substrate travels via a transport 157 back into the document handler 158 for registration with a second toner image on the photoreceptor. After registration, the second toner image is transferred to the substrate at the transfer station 146. The substrate then passes once again through the fuser 150 and the decurler 152. The forwarding rollers 153 then advance the substrate to the output tray 168.

The foregoing describes the general operation of the digital copier 90. However, to better understand the use of flexible belts having embedded sensing fibers in electrophotographic machines, an example of such a use is described in more detail. It should be understood that following description relates to only one use of flexible belts having embedded sensors, that being in controlling the position of scan lines on a photoreceptor. Additional applications of flexible belts having embedded sensing fibers include fusing, transferring, and transporting substrates.

Figure 7:
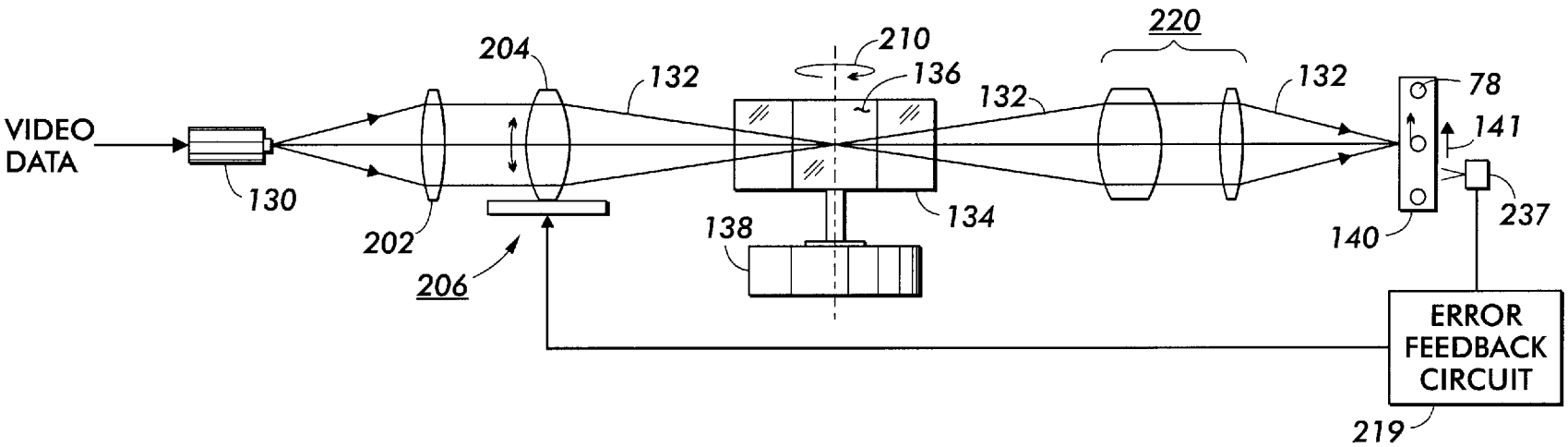
FIG. 7 shows a simplified schematic depiction of the optical system of the electrophotographic marking machine of FIG. 6.

FIGS. 7 and 6 illustrate a raster output scanner as used in the digital copier 90 in more detail. Video data from the controller 100 is applied to the laser diode 130, which produces the modulated laser beam 132. When the laser beam 132 is emitted by the laser diode the beam is diverging. A spherical lens 202 collimates that diverging beam. The collimated beam then enters a cylindrical lens 204, which focuses the beam in the slow scan (process) direction. The cylindrical lens 204 is movable in one plane by a piezoelectric actuator assembly 206. That assembly moves the cylindrical lens in response to motion error signals from an error feedback circuit 219 (which is part of the controller 100). The operation of that feedback circuit is described in some detail below.

After passing through the cylindrical lens 204 the focused laser beam is incident upon the polygon 134 that is rotated by the motor 138 in a direction 210. The mirrored facets 136 deflect the laser beam as the polygon rotates such that the laser beam 132 deflects across the photoreceptor 140, forming a scan line. A post-scan optics system 220 both reconfigures the beam into a circular or elliptical cross-section and refocuses that beam to the proper point on the surface of the photoreceptor 140. The post-scan optics also corrects for various problems such as scan non-linearity (f-theta correction) and wobble (scanner motion or facet errors).

The position of the cylinder lens 204 controls the slow scan (process) direction location of the spot, and thus of the scan line, on the photoreceptor 140. If the cylinder lens is moved up or down the location of the scan line moves in the slow scan direction an amount that depends on the system's magnification. For example, in one embodiment if the cylinder lens moves 204 microns vertically, the scan line advances (in the direction 141) on the photoreceptor by 60 microns. In operation, position error signals applied to the piezoelectric actuator assembly 206 by the error feedback circuit 219 cause the piezoelectric actuator assembly 206 to move the cylindrical lens 204.

The error feedback circuit 219 controls the piezoelectric actuator assembly such that the cylindrical lens 204 moves to compensate for photoreceptor position errors. To that end the photoreceptor 140 benefits from the embedded sensing fibers 78, which in this case are optical fibers. A photosensor 237 that is mounted on the side of the photoreceptor 140 senses light that passes through the optical sensing fibers (a light source on the opposite side of the photoreceptor may be required). The sensed light is used to produce digital timing signals that are applied to the error feedback circuit 219. The error feedback circuit electronically determines when and how much the photoreceptor's position varies from ideal. The error feedback circuit 219 then determines and applies the correct position error signal to apply to the piezoelectric actuator assembly such that the cylindrical lens 204 moves the scan line position to compensate for the photoreceptor's position errors.

Figure 8:
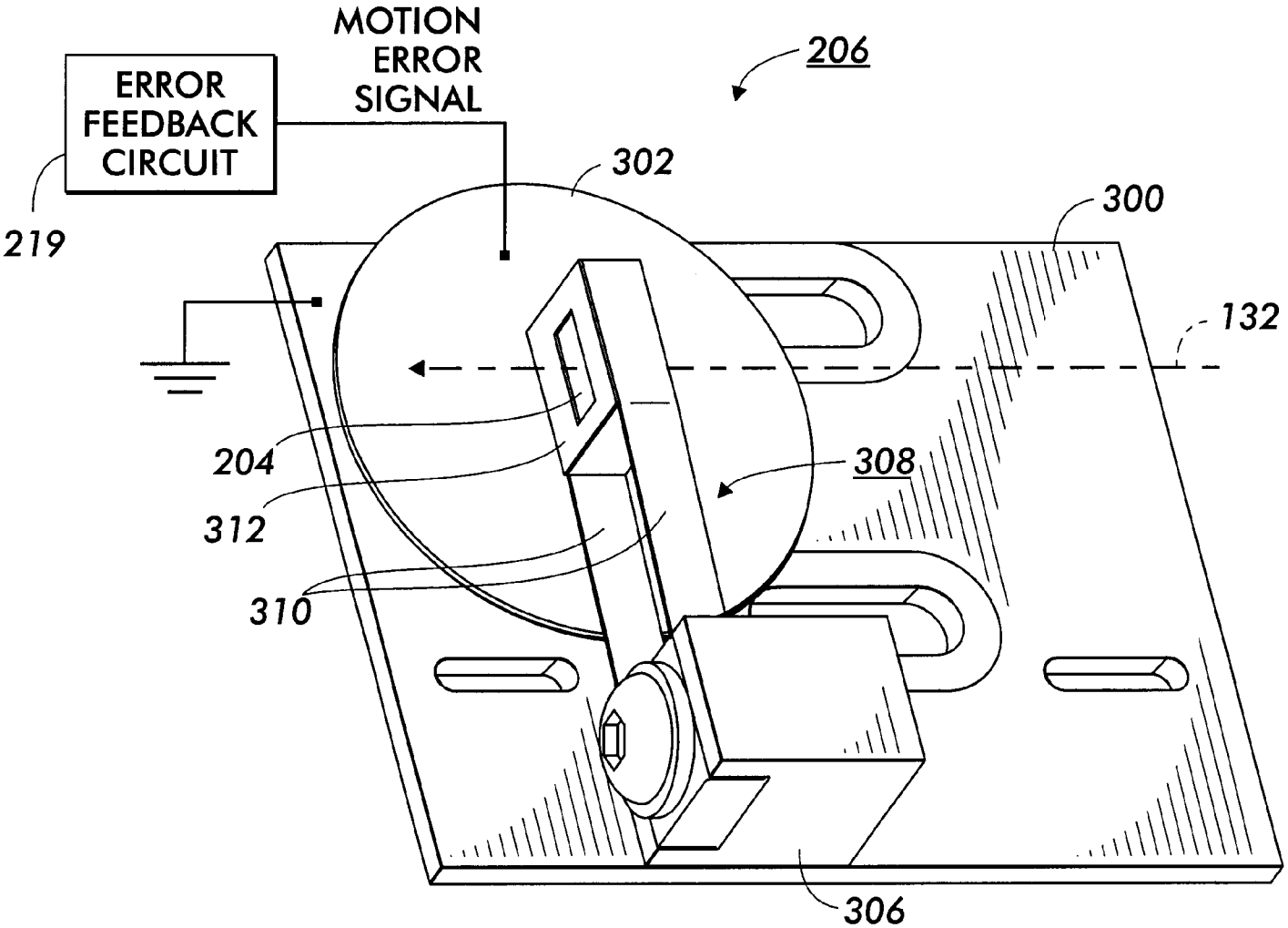
FIG. 8 shows a piezoelectric-actuated lens mover used in the optical system of FIG. 7.

FIG. 8 illustrates the piezoelectric actuator assembly 206. That assembly includes a mounting frame 300, which is beneficially also used to mount the laser diode 130. However, that is not required and FIG. 8 only shows the laser beam 132. A high displacement piezoelectric disk 302 is mounted on the mounting frame 300 such that the one of the metal-plated surfaces connects to the mounting frame. One beneficial piezoelectric disk is a high displacement actuator sold as "Rainbow" by Aura Ceramics. The mounting frame acts as an electrical ground for the piezoelectric disk (alternatively an electrical connection can be made to the piezoelectric disk using a wire). The other metal-plated surface receives via a wire the position error signal. The position error signal is therefore applied across the piezoelectric disk so as to induce that disk to expand and contract.

Also mounted to the mounting frame 300 is an arm mount 306. Attached to that mount is a flexible arm assembly 308. That assembly is comprised of two flexible arms 310 that are flexible in a direction that is normal to the surface of the mounting frame 300, but that are rigid in a direction that is parallel to the surface of the mounting frame. At the end of the flexible arm assembly is a lens holder 312 that holds the pre-polygon cylinder lens 204. The flexible arm assembly mounts to the arm mount 306 such that the flexible arms 310 are biased toward the piezoelectric disk 302. The rigidity of the flexible arms maintains the cylindrical lens at the proper focal position relative to the laser diode 130. Furthermore, the flexibility of the flexible arms enables the piezoelectric element to control the spot position in the slow scan (process) without rotating or otherwise perturbing the cylinder lens in an undesirable direction. Fundamental mechanical properties of dual flexure arms allow this motion while minimizing undesired motion of the cylinder lens, including rotation about and translation along the axis formed by the laser beam path or the axis which defines the cylinder lens curved surface.

Figure 9:
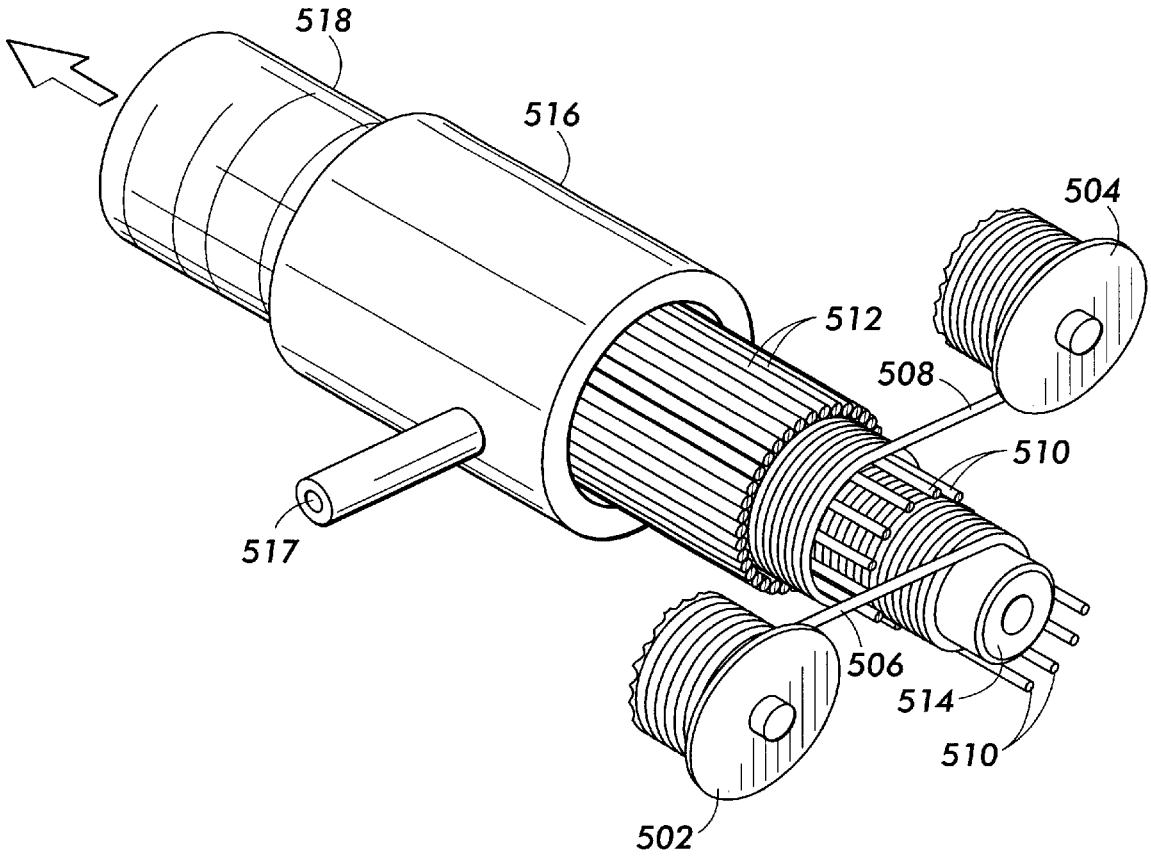
FIG. 9 illustrates an alternative method of fabricating flexible belts having embedded sensors.

FIG. 9 illustrates another method of fabricating belts having embedded sensors. That method uses multiple creels, the creels 502 and 504. The creel 502 holds a belt fiber 506 while the creel 504 holds a belt fiber 508. In addition, multiple creels that are not shown hold sensor fibers 510 and belt fibers 512. Those fibers are all placed on a mandrel 514. As shown, the belt fiber 506 is wound around the mandrel 514 to form a first layer. Then the sensor fibers 510 are placed along the axis of the mandrel to form a second layer. The belt fiber 508 is then wound over the sensor fibers 510 to form a third layer. Finally, the belt fibers 512 are placed along the axis of the mandrel over third layer to form a fourth layer. The fibers are then pulled through a die 516 (see below). The die 516 includes a feed tube 517 that feeds elastomer under pressure to the belt fibers such that the belt fibers become soaked with elastomer as they advance through the die. The die 516 also shapes and finishes the fibers and cures the elastomer to form a flexible tube 518. As the tube is pulled, the sensor fibers 510 and the belt fibers 512 (which run axially) are pulled from their creels. The resulting tube 518 is then cut to form flexible belts such that the sensor fibers 510 run along the width of the flexible belt. Cutting the tube should be performed such that the sensor fibers remain functional. For example, if the sensor fibers 510 are optical fibers the cutting of the belt should be performed such that the ends of the fibers are suitable for receiving and emitting light.

The foregoing method helps illuminate the flexibility of the pultrusion process in forming flexible belts. There may be many more creels, layers, and belt fibers. Different layers can be formed using different combinations of fibers, which may be helically wound. The tube 518 need not itself be a finished product. For example, a tube 518 might pass through more pultrusion stations to receive additional fiber layers, possibly being coated with different elastomers.

The foregoing method illuminates the flexibility of the pultrusion process in forming flexible belts having embedded sensor fibers. There may be many more creels, layers, and fibers. Different layers can be formed using different combinations of fibers, which also may be helically wound. The hose 518 need not itself be a finished product. A hose 518 might pass through more pultrusion stations to receive additional fiber layers, possibly being coated with different elastomers.

While the figures and the above description illustrate the present invention, they are exemplary only. Others who are skilled in the applicable arts will recognize numerous modifications and adaptations of the illustrated embodiment that will remain within the principles of the present invention. Therefore, the present invention is to be limited only by the appended claims.

What is claimed:

1. A flexible belt, comprising:

a continuous first belt layer having a width;

a continuous second belt layer disposed over the first belt layer; and a plurality of sensing fibers embedded between said first belt layer and said second belt layer and extending across the width of said first belt layer.

2. A flexible belt according to claim 1, wherein said sensing fibers are optical fibers.

3. A flexible belt according to claim 1, wherein said sensing fibers are magnetic.

4. A flexible belt according to claim 1, wherein said sensing fibers are conductive.

5. A flexible belt according to claim 1, wherein said first belt layer is comprised of a fiber reinforced elastomer.

6. A flexible belt according to claim 5, wherein the elastomer is a fluoroelastomer of vinylidene fluoride and hexalluropropylene.

7. The flexible belt according to claim 5, wherein the elastomer is a silicone polymer.

8. The flexible belt according to claim 5, wherein the elastomer is a urethane.

9. A flexible belt according to claim 5, wherein said fiber is an aromatic polyamide fiber.

10. A method of fabricating a flexible belt comprising the steps of forming a first belt layer;

placing sensor fibers across a width of the first belt layer; and forming a second belt layer over the sensor fibers and over the fist belt layer.

11. The method of fabricating a flexible belt according to claim 10, wherein the step of forming a first belt layer is comprised of the steps of soaking a fiber in a liquid elastomer;

wrapping the soaked fibers around a mandrel to form the shape of a belt; and curing the soaked first fibers to produce a belt layer.

12. An electrophotographic marking machine, comprising:

an exposure station for exposing a photoreceptor to record a latent image;

a developing station for depositing toner onto said latent image to form a toner image;

a transfer station for transferring said toner image onto a substrate;

a fusing station for fusing said toner image with said substrate;

a cleaning station for removing debris from the photoreceptor; and a controller for controlling the operation of said exposure station, of said developing station, of said transfer station, of said fusing station, and of said cleaning station;

wherein at least one of said exposure station, said developing station, said transfer station, said fusing station and said cleaning station includes:

a moving flexible belt, comprising:

a continuous first belt layer having a width;

a continuous second belt layer disposed over the first belt layer; and a plurality of sensing fibers embedded between said first belt layer and said second belt layer and extending across the width of said first belt layer; and a sensor located along side said flexible belt, said sensor for sensing said sensing fibers and for producing motion signals from said sensing of said sensing fiber; and wherein said controller uses said motion signals to control the operation of at least one of said exposure station, said developing station, said transfer station, said fusing station and said cleaning station.

13. An electrophotographic marking machine according to claim 12, wherein said sensing fibers are optical fibers.

14. An electrophotographic marking machine according to claim 12, wherein said sensing fibers are magnetic.

15. An electrophotographic marking machine according to claim 12, wherein said sensing fibers arc conductive.

16. An electrophotographic marking machine according to claim 12, wherein said belt layer is comprised of a fiber reinforced elastomer.

17. An electrophotographic marking machine according to claim 16, wherein said fiber is an aromatic polyamide fiber.

18. An electrophotographic marking machine according to claim 16, wherein the elastomer is a fluoroelastomer of vinylidene fluoride and hexafluropropylene.

19. An electrophotographic marking machine according to claim 16, wherein the elastomer is a silicone polymer.

20. An electrophotographic marking machine according to claim 16, wherein the elastomer is a urethane.

* * * * *